US008820111B2

(12) United States Patent
Adomat

(10) Patent No.: US 8,820,111 B2
(45) Date of Patent: Sep. 2, 2014

(54) DE-SUPER HEATER CHILLER SYSTEM WITH CONTRA FLOW AND REFRIGERATING FAN GRILL

(75) Inventor: Berthold Adomat, Nassauer Strasse (DE)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 218 days.

(21) Appl. No.: 13/233,876

(22) Filed: Sep. 15, 2011

(65) Prior Publication Data

US 2013/0067949 A1 Mar. 21, 2013

(51) Int. Cl.
*F25D 17/06* (2006.01)
*F25B 6/04* (2006.01)
*F25B 40/04* (2006.01)

(52) U.S. Cl.
CPC .. *F25B 40/04* (2013.01); *F25B 6/04* (2013.01)
USPC ..... 62/428; 62/426; 62/452; 62/458

(58) Field of Classification Search
CPC ..... F25B 40/04; F25B 6/04; F25D 17/06; B23P 15/26; F24F 3/14
USPC ..... 62/428, 426, 452, 454, 455, 458, 430, 62/529, 513
See application file for complete search history.

(56) References Cited

U.S. PATENT DOCUMENTS

| | | | | |
|---|---|---|---|---|
| 5,467,812 | A * | 11/1995 | Dean et al. | 165/62 |
| 6,092,377 | A * | 7/2000 | Tso | 62/173 |
| 6,557,372 | B1 * | 5/2003 | Ozawa et al. | 62/507 |
| 2002/0029583 | A1 * | 3/2002 | Chung et al. | 62/428 |
| 2006/0144076 | A1 * | 7/2006 | Daddis et al. | 62/440 |

* cited by examiner

*Primary Examiner* — Cheryl J Tyler
*Assistant Examiner* — Ana Vazquez
(74) *Attorney, Agent, or Firm* — Sutherland Asbill & Brennan LLP

(57) ABSTRACT

One aspect provides a cooling system, and method of manufacture thereof, that has a housing having at least one condenser attached thereto and an auxiliary condenser attached to the housing. A refrigeration loop fluidly couples at least one condenser and the auxiliary condenser. A compressor forms a portion of the refrigeration loop, wherein the auxiliary condenser is interposed the compressor and at least one condenser within the refrigeration loop that forms a refrigerant path from the compressor to the auxiliary condenser and from the auxiliary condenser to at least one condenser. A fan located within the housing is positioned to force air through the auxiliary condenser and out of the housing.

9 Claims, 4 Drawing Sheets

DE-SUPER HEATER CHILLER SYSTEM WITH CONTRA FLOW AND REFRIGERATING FAN GRILL

TECHNICAL FIELD

This application is directed, in general, to a cooling system and, more specifically, to a cooling system having an auxiliary condenser associated therewith.

BACKGROUND

Chiller cooling systems are well known and have been implemented in cooling commercial and large residential buildings for many decades. Chillers use a refrigerating system to cool a cooling fluid, such as water, typically to a temperature of about 20° C. This cooled water is then transported by a conduit system to a heat exchanger where air that is forced through the heat exchanger is cooled. The heat exchange between the air and the cooled water warms the water and it is returned to the reservoir tank where it is then cooled back down. In the past, these chiller systems have often been very large. However, over time, manufacturers have been successful in significantly reducing the overall size of these units, while maintaining adequate efficiency.

SUMMARY

One aspect provides a cooling system. In this embodiment, the cooling system comprises a housing having at least one condenser attached thereto and an auxiliary condenser attached to the housing. A refrigeration loop fluidly couples the at least one condenser and the auxiliary condenser. A compressor forms a portion of the refrigeration loop, wherein the auxiliary condenser is interposed the compressor and the at least one condenser within the refrigeration loop that forms a refrigerant path from the compressor to the auxiliary condenser and from the auxiliary condenser to the at least one condenser. A fan located within the housing is positioned to force air through the auxiliary condenser and out of the housing.

Another embodiment provides a method of manufacturing a cooling system. The method comprises attaching at least one condenser to a housing, attaching an auxiliary condenser to the housing, coupling the at least one condenser and the auxiliary condenser with a refrigeration loop, placing a compressor within the refrigeration loop, such that the auxiliary condenser is interposed the compressor and the at least one condenser within the refrigeration loop, to form a refrigerant path from the compressor to the auxiliary condenser and from the auxiliary condenser to the at least one condenser, and locating a fan within the housing to force air from within the housing through the auxiliary condenser.

Another embodiment of a cooling system is also provided. In this particular embodiment, the cooling system comprises a housing having opposing condensers that form opposing side walls of the housing, and an auxiliary condenser attached to the housing that forms a top wall of the housing. A refrigeration loop fluidly couples the opposing condensers to the auxiliary condenser. A compressor is located within the housing and forms a portion of the refrigeration loop, wherein the auxiliary condenser is interposed the compressor and the opposing condensers within the refrigeration loop to form a refrigerant path from the compressor to the auxiliary condenser and from the auxiliary condenser to the opposing condensers. A fan is located within the housing and between the compressor and the auxiliary condenser and configured to force air through the auxiliary condenser and out of the housing. An evaporator is located within a fluid tank that is fluidly coupled to the opposing condensers by the refrigeration loop.

BRIEF DESCRIPTION

Reference is now made to the following descriptions taken in conjunction with the accompanying drawings, in which.

DETAILED DESCRIPTION

Figure 1:
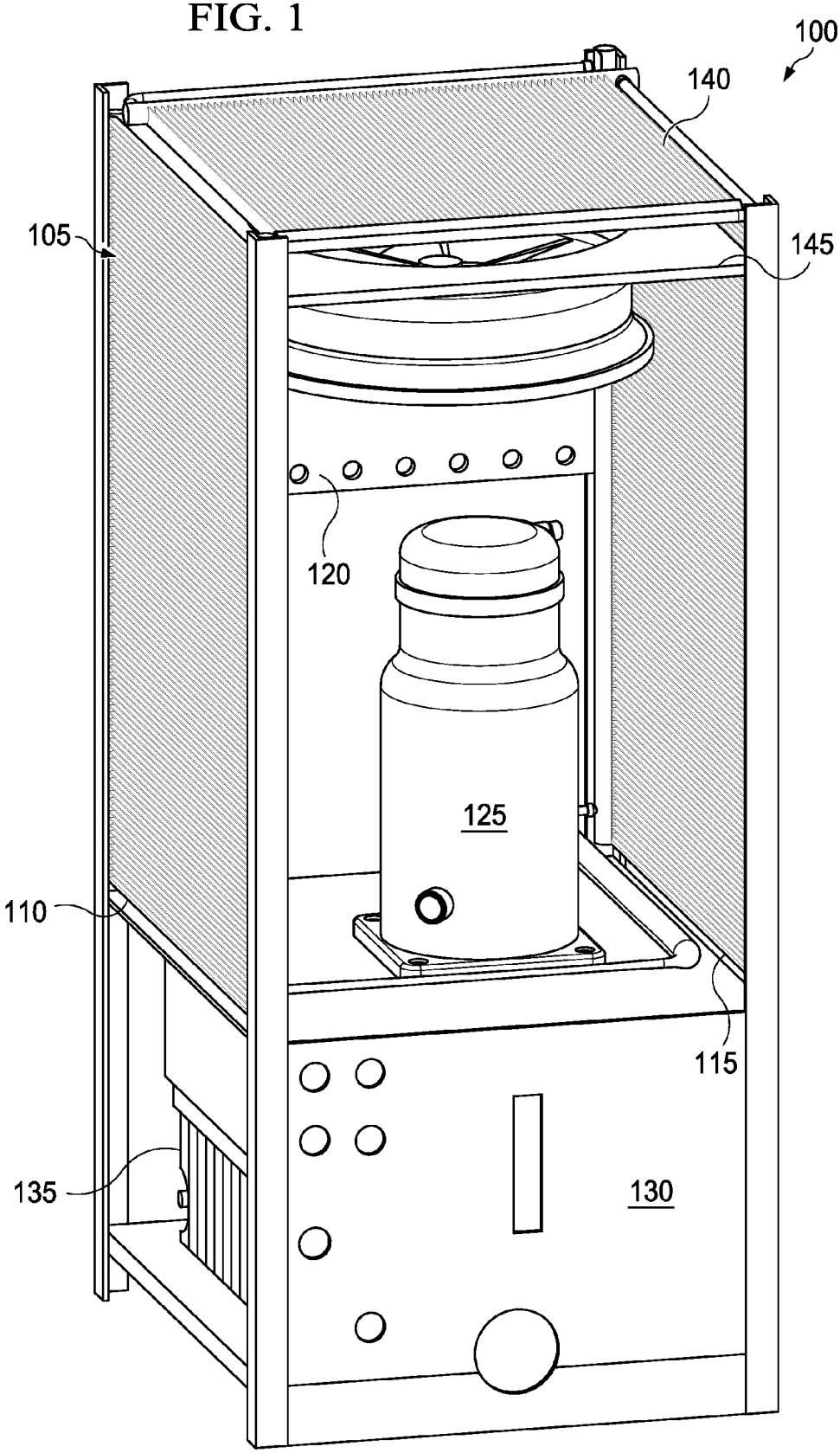
FIG. 1 illustrates a perspective view of one embodiment of a cooling system, as provided herein.

FIG. 1 illustrates one embodiment of a cooling system 100, such as a compact chiller, as described herein. This embodiment comprises a housing 105, which due to the benefits as provided herein, may be very compact in size, yet provide an improved increase in efficiency over conventional designs. For example, the entire housing 105 may have a footprint of 1 meter by 1 meter, yet adequately provide enough cooling fluid for commercial building applications with increased cooling capacity and efficiency. In the illustrated embodiment, two walls of the housing 105 are condenser panels 110, 115 that are attached to the frame of the housing 105. Though two condensers are shown, other embodiments provide for one condenser or more than two wall condensers. In the illustrated embodiment, the two condensers 110, 115 oppose each other. The other walls of the housing 105 may be a conventional control panel 120, a portion of which is shown, and the other wall may be another condenser, or simply a blank sheet metal panel. Though the condensers 110, 115, in one embodiment, may be conventional copper or aluminum coils, in other embodiments, the condensers 110, 115 are microchannel coils. The use of microchannel coils is ideally suited when the manufacture wishes to reduced the overall size of the unit or decrease refrigerant charge.

For years, microchannel coil technology has been used in the automotive industry in order to increase heat transfer efficiency and improve reliability through a higher level of corrosion resistance. However, as governmental regulations have required higher SEER cooling units, heating ventilation air conditioning (HVAC) manufacturers have recognized benefits in using microchannel coils in residential and commercial refrigeration applications because their smaller size reduces the footprint of condensing units. In addition, microchannel coils have improved heat transfer characteristics, and enhanced durability and serviceability.

A typical microchannel coil is constructed of parallel flow aluminum tubes that are mechanically brazed to enhanced aluminum fins, resulting in better heat transfer and a smaller, lighter, corrosion resistant coil. As such, microchannel coils are 40% smaller than conventional condenser or evaporator coils, 40% more efficient, and use 50% less refrigerant than standard tube and fin coils.

The illustrated embodiment further includes a conventional compressor 125 and a fluid reservoir tank 130 in which an evaporator 135 is located. It should be understood that the compressor 125, as well as the fluid reservoir tank 130 and the evaporator 135 may be located in a separate housing and need not, in all embodiments, be contained within the housing 105.

The top panel of the housing 105 is an auxiliary condenser 140, which may be known as a de-superheater. Though FIG. 1 shows the auxiliary condenser 140 located in the top panel of the housing 105, it should be understood that in other embodiments, the auxiliary condenser 140 may be located on a side wall of the housing 105. As used herein an auxiliary condenser is a condenser that removes heat from heated refrigerant received from the compressor 125 and is interposed the compressor 125 and the condensers 110 or 115, or both when present, within a refrigerant loop of the cooling system 100. The details of this refrigerant flow are explained in more detail below.

The illustrated embodiment may further include a fan 145 located within the housing 105. The fan 145 is configured and positioned to produce an air flow through the auxiliary condenser 140 and out of the housing 105. The fan 145 produces a negative air pressure within the housing 105, which draws air from outside and through the side condensers 110 and 115. The details of this air flow through the housing 105 are also explained below. The fan 145 is, preferably but not necessarily, located adjacent the auxiliary condenser 140. In such embodiments, the auxiliary condenser 140 may also serve has a fan grill that protects the fan from debris and avoid injury.

In one embodiment, the auxiliary condenser 140 may also be a microchannel coil. However, in one specific embodiment, the auxiliary condenser 140 is a microchannel coil that is finless, in that it does not include the cooling fins typically associated with microchannel coils. In such embodiments, the finless coil provides for enhanced air flow through it and prevents back pressure build-up in the housing 105. In other embodiments, however, the auxiliary condenser 140 may include a limited number of cooling fins for enhanced heat exchange, such that a back pressure build-up does not occur to an extent that would significantly affect the cooling efficiency of the cooling system 100.

Figure 2:
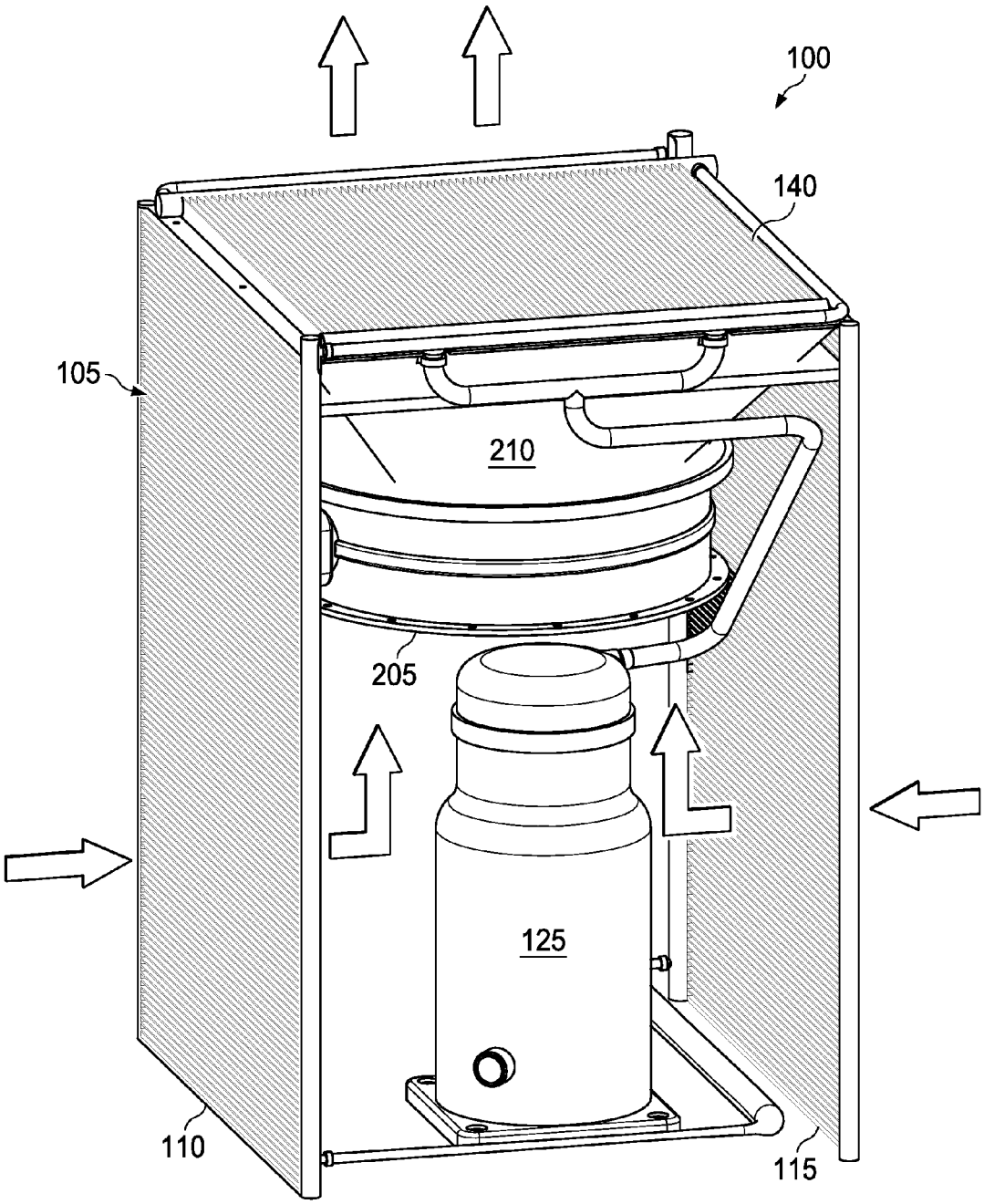
FIG. 2 illustrates a schematic view of a portion of one embodiment of the cooling system, as provided herein.

FIG. 2 illustrates a partial, but more detailed, view of the cooling system 100 of FIG. 1. This view primarily illustrates the air flow through the unit. In this particular embodiment, the condensers 110 and 115 form opposing walls of the housing 105 and the auxiliary condenser 140 forms a top wall of the housing 105. The fan (not shown in this view) is contained in the fan shroud 205 that is connected to a duct 210 that directs the air through the auxiliary condenser 140.

During operation, air from outside the housing 105 is drawn through the condenser 110, 115 by the fan 145 (FIG. 1), as indicated by the directional arrows. As the air, which for example may have a temperature of about 40° C., passes through the condensers 110, 115, it absorbs heat from the condensers 110, 115 and warms it by several degrees, for example to about 46° C. The fan 145 (FIG. 1) draws in the warmed air and forces it through the auxiliary condenser 140, where the air absorbs heat from the auxiliary condenser 140 and warms further to about 48° C. This airflow and temperature sequence forms a contra flow within the housing 105, which provides a benefit of increasing the cooling capacity of the unit.

Figure 3:
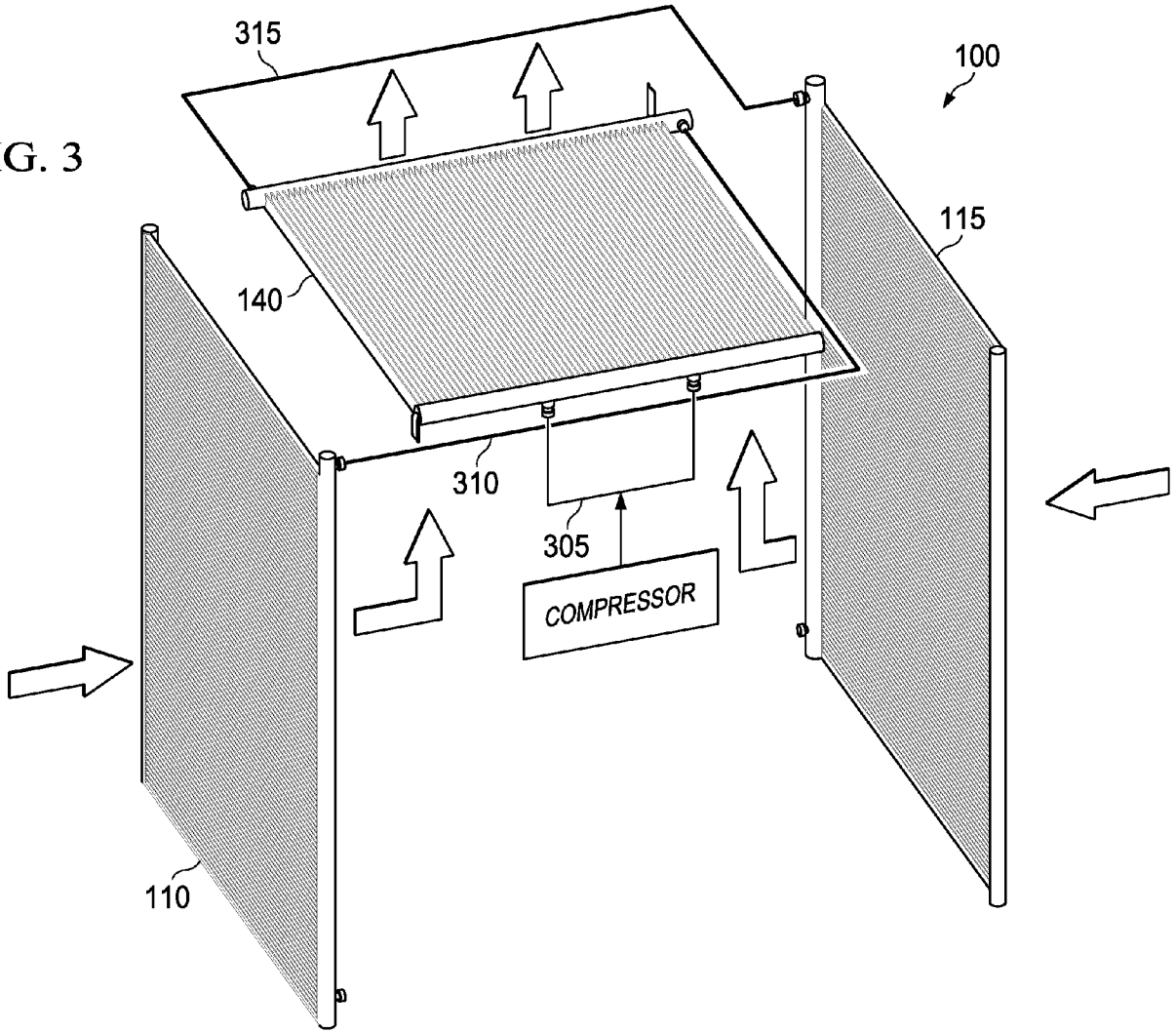
FIG. 3 illustrates a schematic view of a portion of one embodiment of the cooling system showing a portion of the refrigeration loop, as provided herein.

FIG. 3 illustrates a more schematic view of FIG. 2 to provide a better understanding of the refrigerant flow in the cooling system and the benefits obtained thereby. The air flow, as indicated by the directional arrows, and the temperature changes, are as described above regarding FIG. 2. As seen in this embodiment, the compressor 125 is fluidly connected to the auxiliary condenser 140 by refrigerant tubes 305 and the auxiliary condenser 140 is fluidly connected to the condensers 110, 115 by refrigerant tubes 310 and 315 respectively. This configuration forms a refrigerant loop among the compressor, the auxiliary condenser 140, and the condensers 110, 115.

The tubes 305 allow heated refrigerant, which may be at temperatures of around 90° C. to 100° C., from the compressor 125 to pass through the microchannels of the auxiliary condenser 140. The cooler air (about 46° C.) from within the housing is passed through auxiliary condenser 140 by the fan, which in turn cools the heated refrigerant from the compressor to around 60° C. before it flows from the auxiliary condenser 140 to the condensers 110 and 115 by way of tubes 310 and 315. Because of the presence of the auxiliary condenser 140, the heated refrigerant is cooled before circulating back to the condensers 110, 115, which more easily allow the refrigerant to liquefy. This configuration has shown to significantly increase the cooling capacity of the cooling system 100 by about 20%. This unique configuration provides the advantage of creating more cooling capacity in a smaller unit than provided by conventional cooling systems. This advantage is in contrast to conventional cooling systems that would require that the condensers 110, 115 be much larger with more refrigerant to achieve the same amount of temperature drop in the refrigerant when leaving the condensers 110, 115.

With reference to FIG. 1, in one embodiment of manufacture the cooling system 100 may be manufactured by conventional processes, unless otherwise noted herein. At least one of the condensers 110, 115 is attached to a frame of the housing 105. As mentioned above, both condensers 110, 115 may be present and may be attached on the appropriate sides of the housing 105 such they oppose one another. The auxiliary condenser 140 is also attached to a side of the housing 105, and in one embodiment, it is attached to the top portion of the housing 105. The condensers 110, 115, when both present, are separately coupled to the auxiliary condenser 140 by tubing. The compressor 125 is coupled to the refrigeration loop such that the auxiliary condenser 140 is interposed the compressor 125 and at least one of the condensers 110,115 within the refrigeration loop, to form a refrigerant path from the compressor 125 to the auxiliary condenser 140 and from the auxiliary condenser 140 to at least one of the condensers 110, 115. When both condensers 110, 115 are present, the auxiliary condenser 140 is fluidly coupled to both condensers 110, 115 by separate tubes. The fan 145 is conventionally attached and positioned within the housing 105 to force air from within the housing 105 through the auxiliary condenser 140.

Figure 4:
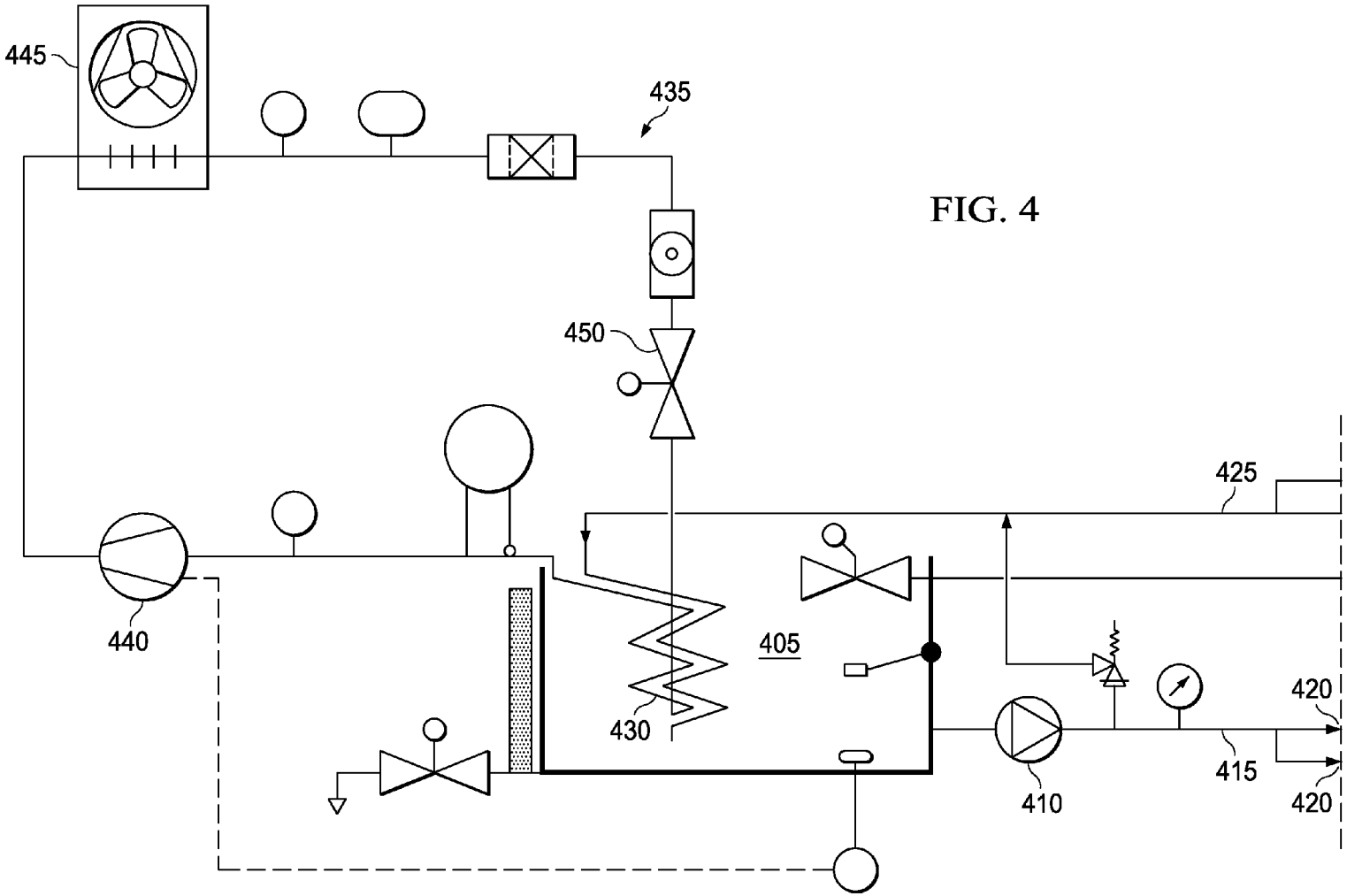
FIG. 4 illustrates a schematic diagram of one embodiment of the cooling system, as provided herein.

FIG. 4 illustrates an operations schematic diagram of one embodiment of a cooling system in which the auxiliary condenser 140 may be used. Cooled fluid, such as water or similar cooling fluids is pulled from tank 405 by pump 410. The pump 410 pushes the cooled fluid through a conduit 415, which may be at a temperature of 20° C., to customers' 420 heat exchangers not shown to provide cooling to their spaces. As the cooling fluid is pushed through the customers' heat exchangers, the cooling fluid absorbs heat and is warmed to a temperature of about 25° C. to about 30° C. These temperatures are given as examples only, and those skilled in the art will understand that the temperature may vary greatly, depending on the design and requirements of the cooling system. The pump 410 pushes the warmed cooling fluid through conduit 425 back to the tank 405, where an evaporator 430 cools the cooling fluid down to the required cooling temperature.

The refrigerant, which is in primarily a gaseous state, within refrigerant loop 435 is pulled from the evaporator 430 by compressor 440, where it is compressed into a hot gas having a temperature, for example, of about 90° C. to about 100° C. The compressor 440 pushes the hot compressed gas through condenser unit 445, which comprises the auxiliary condenser 140 (FIGS. 1-3) and condenser 110, 115 (FIGS. 1-3) as previously described. When passing through the condensers 140, 110, and 115 in the manner described above, the refrigerant turns to a liquefied state. The compressor 440 continues to push the liquefied refrigerant through a conventional expansion valve 445, where the refrigerant rapidly boils into a vapor, thereby absorbing a large amount of heat as it enters the evaporator. The cold gas then absorbs heat from the cooling fluid, thereby cooling the cooling fluid for transmission as described above.

Those skilled in the art to which this application relates will appreciate that other and further additions, deletions, substitutions and modifications may be made to the described embodiments.

What is claimed is:

1. A cooling system, comprising:

a housing having discrete opposing condensers that form opposing side walls of said housing;

an auxiliary condenser attached to said housing that forms a top wall of said housing;

a refrigeration loop fluidly coupling said opposing condensers to said auxiliary condenser, such that the auxiliary condenser is positioned in between the opposing condensers in the refrigeration loop;

a compressor, located within an interior space of said housing and forming a portion of said refrigeration loop, wherein said auxiliary condenser is fluidly interposed with said compressor and said opposing condensers, such that said compressor is fluidly connected to said opposing condensers through said auxiliary condenser to form a refrigerant path from said compressor to said auxiliary condenser and from said auxiliary condenser to said opposing condensers;

a fan located within the same interior space of said housing as the compressor and between said compressor and said auxiliary condenser and positioned to pull air through said opposing condensers and force the air through said interior space of said housing and through said auxiliary condenser and out of said housing; and an evaporator located within a fluid tank, said refrigeration loop fluidly coupling said evaporator with said compressor.

2. The cooling system of claim 1, wherein said auxiliary condenser is comprised of a finless coil.

3. The cooling system of claim 1, wherein said auxiliary condenser and said opposing condensers are microchannel coils.

4. The cooling system of claim 1, wherein said fluid tank is a water tank.

5. The cooling system of claim 4, wherein said water tank is fluidly connectable to a separate heat exchanger.

6. The cooling system of claim 1, wherein said refrigeration loop is configured such that hot gas is pushed from said compressor to said auxiliary condenser and from said auxiliary condenser to said opposing condensers.

7. The cooling system of claim 1, wherein said opposing condensers and said auxiliary condenser form a condensing unit and said cooling system further comprises an expansion valve located in said refrigeration loop between said condensing unit and said evaporator.

8. The cooling system of claim 1, wherein said auxiliary condenser is a microchannel coil.

9. The cooling system of claim 1, wherein said opposing condensers are microchannel coils.

* * * * *